United States Patent [19]

Bubendorff

[11] Patent Number: 4,683,932

[45] Date of Patent: Aug. 4, 1987

[54] ROLLING SHUTTER

[76] Inventor: Richard Bubendorff, Rue des Acacias, 68220 Hegenheim, France

[21] Appl. No.: 673,138

[22] Filed: Nov. 19, 1984

[30] Foreign Application Priority Data

Nov. 21, 1983 [FR] France ..... 83 18610
Jan. 1, 1984 [FR] France ..... 84 03347

[51] Int. Cl.[4] ..... E06B 9/14
[52] U.S. Cl. ..... 160/133; 160/310
[58] Field of Search ..... 160/133, 32, 33, 36, 160/120, 310, 311, 300, 302; 242/67.2, 67.4

[56] References Cited

U.S. PATENT DOCUMENTS

| | | | |
|---|---|---|---|
| 541,696 | 6/1895 | Spaulding | 160/133 X |
| 558,577 | 4/1896 | Spaulding | 160/133 |
| 705,553 | 7/1902 | Blake | 160/133 |
| 1,171,215 | 2/1916 | Lane | 160/300 |
| 1,324,421 | 12/1919 | Biasucci | 160/300 |
| 1,522,352 | 1/1925 | Wertheimer | 160/120 X |
| 1,710,874 | 4/1929 | Hoch | 160/133 X |
| 2,173,900 | 9/1939 | Dunn | 160/133 X |
| 2,248,538 | 7/1941 | Liebler | 160/133 X |
| 2,934,139 | 4/1960 | Wardlaw et al. | 160/310 X |
| 3,019,450 | 2/1962 | Karasiewicz | 160/133 X |
| 3,285,089 | 11/1966 | Tsugawa | 160/310 X |
| 3,490,514 | 1/1970 | Duncan et al. | 160/33 X |
| 4,417,185 | 11/1983 | Bullat | 160/310 X |
| 4,494,707 | 1/1985 | Niibori et al. | 160/265 X |

FOREIGN PATENT DOCUMENTS

| | | | |
|---|---|---|---|
| 1107123 | 5/1961 | Fed. Rep. of Germany | 160/133 |
| 2325755 | 12/1974 | Fed. Rep. of Germany | 160/310 |

*Primary Examiner*—Ramon S. Britts
*Assistant Examiner*—David M. Purol
*Attorney, Agent, or Firm*—Darby & Darby

[57] ABSTRACT

A rolling shutter includes a winding and/or unwinding shaft for a sectional structure consisting of blades provided with a catch mechanism engageable by a driving mechanism rotatably rigid with a second shaft disposed downstream of the winding shaft and held by lateral flanges of the shutter housing. The shutter further includes guide rails slidably engaged by the lateral ends of the blades. The second shaft includes at either end a driving mechanism having a backlach consistent with the variable pitch existing between the catch mechanism of two adjacent blades. The driving mechanism is adapted to be actuated by a motor for causing the rotation of the winding shaft in one or the other direction.

2 Claims, 5 Drawing Figures

ROLLING SHUTTER

BACKGROUND OF THE INVENTION

1. Field of the Invention

This invention relates in general to rolling shutters for doors, windows and other apertures, and has specific reference to a rolling shutter of the type comprising a first shaft for winding and/or unwinding a sectional structure consisting of blades provided with catch means adapted to be engaged by driving means mounted on and rotatable with a second shaft located downstream of the winding shaft and mounted in lateral flanges of the shutter housing, and guide rails slidably engaged by the side ends of the shutter blades.

2. The Prior Art

It is known to protect the roofs of glass verandahs and attic windows against sun beams by means of a rolling shutter movable in a substantially horizontal plane. In contrast to vertical rolling shutters, horizontal shutters are not responsive to gravity and therefore some means must be provided for moving the sectional structure of a horizontal rolling shutter in either direction.

In a document No. DE-A-2,947,501 there is disclosed a rolling shutter wherein the blades constituting the sectional structure are interconnected by hinge means consisting of a C-section having its two bent ends slidably engaged in slots formed in the longitudinal edges of the blades. These bent ends cooperate with boss means formed in, or rigid with, one wall of said slots. The longitudinal edges of the blades are provided with end members or inserts fitted into the blades. These end members or inserts comprise several studs of which the relative spacing corresponds to the pitch of the driving sprockets.

However, to obtain a proper operation of this rolling shutter the distance between the axes of the first stud of the upstream blade and the first stud of the downstream blade must be the same as the distance between the axes of the various studs rigid with the end members. However, this distance between the axes of the last stud of the upstream blade and the first stud of the downstream blade varies as a function of the direction of travel of the shutter. In a first direction, the shutter movement is obtained by transmitting a thrust from one blade to another. For this purpose, the longitudinal edges of the two adjacent blades contact each other and the distance between the axes of the last stud of the upstream blade and the first stud of the downstream blade has its minimum value.

In the other direction, the sectional structure is driven by a tractive force transmitted from one blade to another through said C-section. Under these conditions, a stretching stress is produced and the distance between the axes of the last stud of the upstream blade and the first stud of the downward blade has its maximum value.

The value of the distance between centers of the studs of said end members corresponds either to the minimum value or to the maximum value, but in no case to both values simultaneously. Thus, in one direction there is compulsorily an alternation between the distance measured between the studs of a same blade and the axial distance between the studs of two adjacent blades. This alternation is inconsistent with the regular pitch of the sprocket teeth.

SUMMARY OF THE INVENTION

It is the primary object of the present invention to avoid the inconveniences of the prior art propositions by solving the problem consisting in designing a rolling shutter comprising a first shaft for winding and/or unwinding a sectional structure made of hingedly interconnected blades and a second shaft provided at its ends with driving means having a backlash consistent with the variable pitch existing between the driving means of two adjacent blades, said driving means being actuated by power means for rotatably driving said winding and/or unwinding shaft.

The advantageous feature characterizing the present invention consists essentially in that the driving means have a pitch adapting itself to the variable pitch resulting from the movement in opposite directions of the blades, so that the sectional structure of the shutter can travel horizontally in both directions.

THE DRAWINGS

DESCRIPTION OF THE PREFERRED EMBODIMENTS

Figure 1:
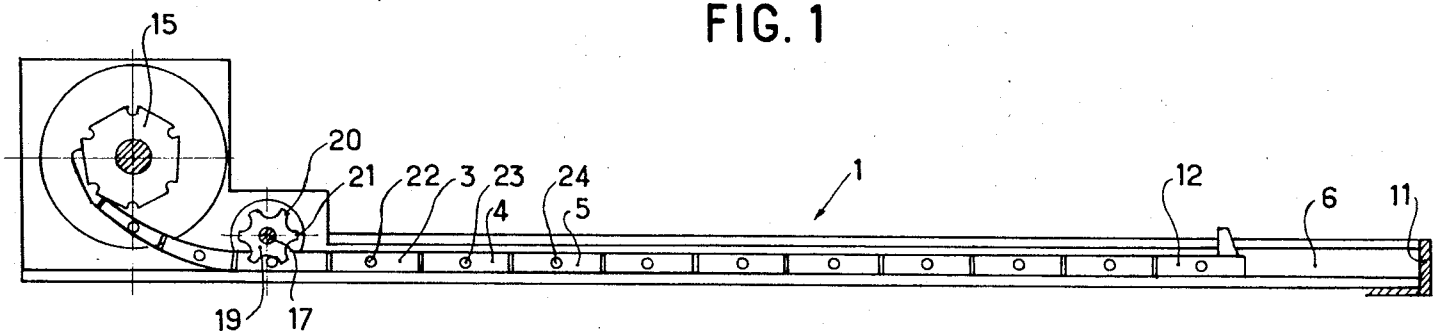
FIG. 1 is a diagrammatic side elevational view of a rolling shutter constructed according to the teachings of the present invention.
Figure 2:
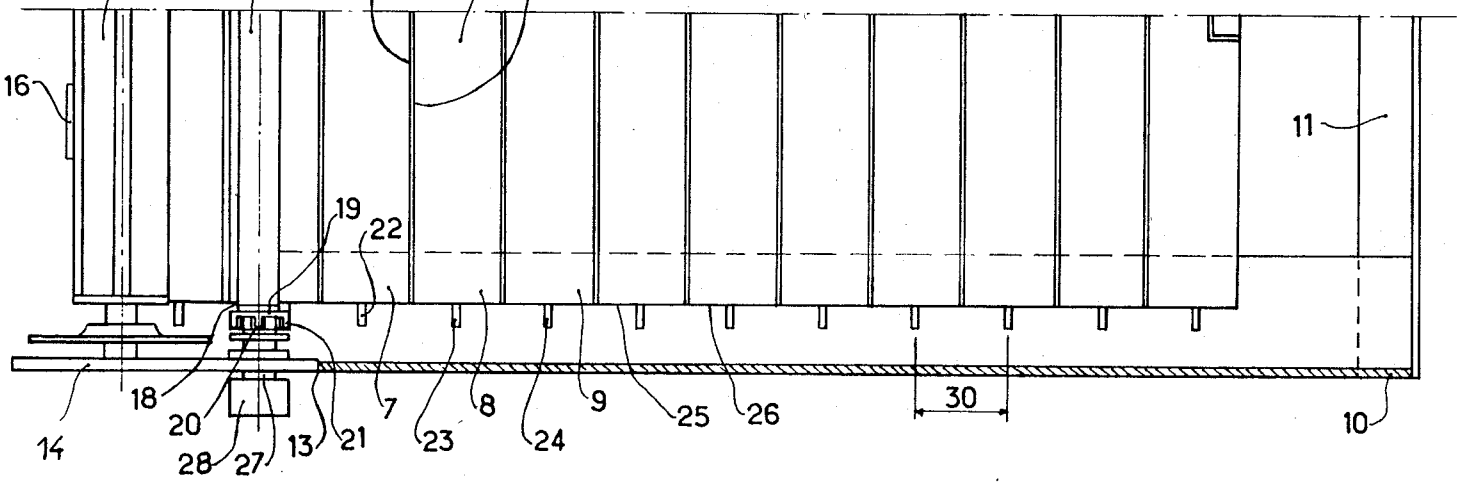
FIG. 2 is a fragmentary plane view from above of the rolling shutter of FIG. 1.

Referring first to FIGS. 1 and 2 of the drawings, the rolling shutter 1 comprises essentially a sectional structure 2 consisting of a plurality of blades 3, 4, 5 . . . , hingedly interconnected by any suitable and known means. This sectional structure 2 is guided on both longitudinal sides by a pair of guide rails 6 consisting of U-sections. The two parallel wings of guide rails 6 encompass the lateral ends 7, 8, 9 of blades 3, 4, 5 adapted to slide between said parallel wings. The two parallel rails 6 are interconnected at one end 10 by a cross member 11 constituting a stop member engageable by the last blade 12 of the sectional structure 2 in its extended condition. The other end 13 of guide rails 6 is rigidly connected to the lateral flanges or walls of the shutter housing which support a winding shaft 15 on which the sectional structure 2 is adapted to be wound or unwound, the first blade of this structure 2 being anchored by suitable means 16 to said shaft 15.

According to a specific feature of the present invention, the rolling shutter 1 comprises another shaft 17 parallel to the winding shaft 15. This second shaft 17 disposed downstream of shaft 15 is also held in position by lateral flanges or walls of the shutter housing. The second shaft 17 comprises driving means cooperating with catch means connected to the various blades 3, 4, 5 of sectional structure 2. For this purpose, driving means are provided on both sides 18 of shaft 17. These driving means consist of cam wheels 19 adapted to mesh with projections in the form of separate studs 22, 23, 24 for each blade 3, 4, 5. These studs 22, 23, 24 project from the two end faces 25, 26 of blades 3, 4, 5. The cam wheels 19 are rotatably rigid with the second shaft 17 and a predetermined backlash is provided therebetween. For this purpose, the cam wheels 19 have a spider-like configuration of which the arms 20, 21 have the shape of involutes of curves (see FIG. 4). These arms 20, 21 are interconnected by a curvilinear concave segment 27. By virtue of this particular shape of arms 20, 21, the studs 22, 23, 24 can move under no-load conditions to a certain extent by sliding along the side faces 28, 29 of arms 20, 21 so as to position themselves as a function of the pitch or distance between centers 30 of two adjacent studs 22, 23. In fact, this pitch 30 varies as a function of the direction of travel of the sectional structure 2. When the shutter is unrolled, each blade 4 thereof exerts a thrust on the preceding blade. Thus, the longitudinal edges 31, 32 of blades 3, 4 are in close contact with each other and the pitch 30 has its minimum value. On the other hand, when the shutter is rolled up a tractive effort is exerted on blades 3, 4 which tends to move these blades apart from each other. Thus, pitch 30 has its maximum value. The difference between the maximum and minimum values of pitch 30 is taken up by the sliding movement of studs 2, 23, 24 along the sides 28, 29 of the arms 20, 21 of cam wheel 19.

Since the sectional structure 2 of shutter 1 is driven in both rolling and unrolling directions, it is possible to dispose the rolling shutter 1 in a horizontal plane or to arrange the assembly comprising the rolling shaft 15 and the driving shaft 17 at the bottom of a vertical rolling shutter. Of course, the rolling shutter of this invention may also be disposed in any intermediate position between the horizontal position and the vertical position.

According to a first form of embodiment of the present invention, the power means drive only the second shaft 17. This shaft 17 extending through one of the flanges 14 is coupled to a manual or automatic control device adapted to rotatably drive this second shaft 17. Thus, the second shaft is the driving shaft and the first shaft 15 for rolling up the shutter 2 is the driven shaft. Since this first shaft 15 is mounted for free rotation the thrust exerted on the shutter 2 by the second shaft 17 causes the winding shaft 15 to rotate. A spring adapted to be stressed during the unrolling of the sectional structure 2 and operative during the rolling up period is incorporated in the winding shaft 15 to facilitate the rotation of this winding shaft 15 as the blades 3, 4, 5 pushed by the arms 20, 21 of cam wheels 19 of second shaft 17 are being wound on shaft 15.

However, in the long run the spring tends to be overstressed. Therefore, it is necessary to either change the spring or provide adjustment means for modifying the defective spring. For this purpose the present invention provides a second form of embodiment wherein the power means are adapted to drive either the rolling-up shaft 15 or the second shaft 17.

Figure 3:
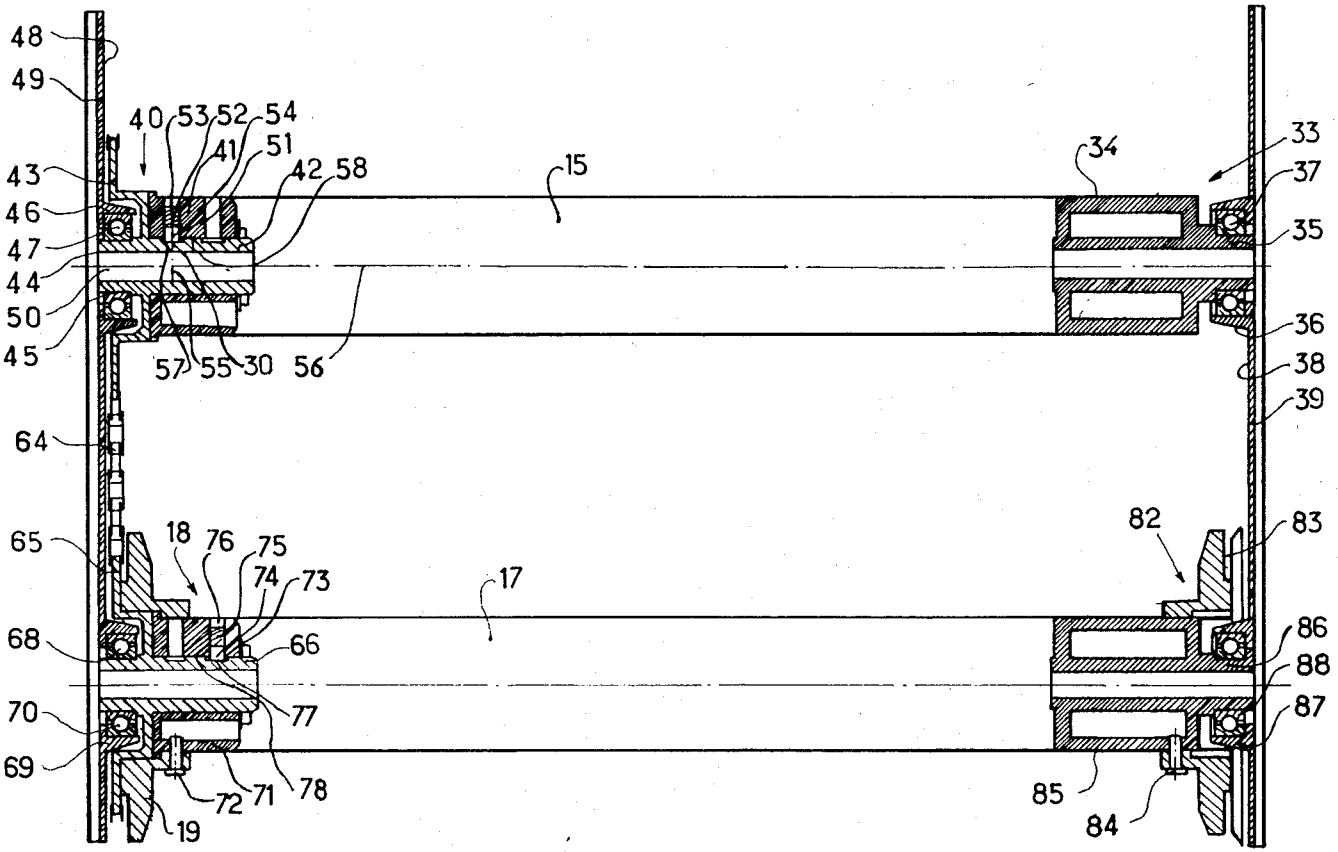
FIG. 3 is a sectional and plane view showing on a larger scale the means for driving the rolling shutter.
Figure 4:
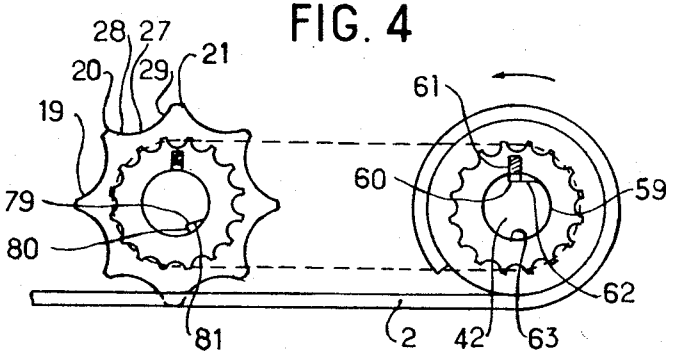
FIG. 4 is a diagrammatic side elevational view showing the principle of operation of the driving means.

Referring to FIGS. 3 and 4 of the drawings, the shaft 15 comprises at one end 33 a cylindrical end member 34 provided with a hub 35 journalled in a ball-bearing 37 and rigidly connected to the inner face 38 of one of the lateral flanges 39 of the shutter housing.

At its other end 40 this shaft 15 has a freewheel-forming end member 41 having fitted therein a hub 42 rigidly connected to a sprocket 43. The freewheel end member 41 is rotatably coupled with shaft 15 but when necessary it may be independent of the rotation of the hub 42. This hub 42 is provided at its outer end with a journal 45 engaged in the inner ring of a ball-bearing 47 fitted in turn in a plummer-block 46 rigidly connected to the inner surface 48 of the other lateral flange or wall 49 of the shutter housing. This hub 42 comprises a bore 50 adapted to be engaged by a driving member such as the shaft of a winch (not shown).

The freewheel end member 41 is provided with a lock bolt 51 urged to its locking position by a resilient member 52 retained by a tightening member such as a screw 53. This lock bolt 51, together with resilient member 52 and tightening member 53 are disposed in a hole 54 having its axis perpendicular to the longitudinal axis 56 of winding shaft 15. The inner end of lock bolt 51, in its operative position, projects from the inner surface of bore 58 formed in the freewheel end member 41 engaged by said hub 42. A notch 60 having a width corresponding to the diameter of lock bolt 51 is formed in the outer peripheral surface of hub 42. This notch 60 has an operative face 61 adapted to be engaged by lock bolt 51 when the winding shaft 15 is driven by the winch for rolling up the sectional structure 2. A set-back face 62 is formed in notch 60 at right angles to the operative face 61. This operative face 61 is parallel to the axis 55 of hole 54 and therefore to the direction of movement of lock bolt 51. When the hub 42 rotates in the opposite direction, i.e. for unrolling the sectional structure 2, the set-back face 62 engages the lock bolt, which is resiliently urged toward the bore 50, causes the lock bolt 51 to be retracted so that this bolt 51 will bear against the peripheral surface 63 of hub 42. When the hub 42 rotates in this direction, there is no radial surface for the lock bold to engage. Consequently, the hub 42 is disconnected from the freewheel end member 41 and the rotation of hub 42 becomes independent of the rotation of this freewheel end member 41. Thus, during the unrolling movement of shutter 2, the winding shaft 15 rotates without being driven by the winch.

The sprocket 45 is drivingly coupled through an endless chain 64 to another sprocket 65 rigid with a hub 66 formed at one end 18 of the second shaft 17 parallel to winding shaft 15. This hub 66 comprises a journal 68 engaged in a plummer-block 69 in which a ball-bearing 70 rigid with the inner face 48 of the adjacent lateral flange or wall 49 is fitted. A freewheel end member 71 engaging the end 16 of the second shaft 17 is fitted on said hub 66. This freewheel end member 71 is rotatably rigid with a member 72 for fastening the cam wheel 19 meshing with the lateral studs 22, 23, 24 of the successive blades 2, 3, 4 of shutter 2. In the freewheel end member 71 at least one orifice 73 is formed for engagement by a lock bolt 74 and its resilient member 75 tensioned by a tightening member 76. The inner end 77 of lock bolt 74 projects from the inner surface of a bore 78 formed in the freewheel end member 71 and engages a notch 79 formed in said hub 66. This notch 79 has the same configuration as the notch 60 of hub 42; in other words, it comprises an operative face 80 and a set-back face 81 perpendicular to said operative face 80. However, whereas in the notch 60 a set-back face is located on the right with respect to the operative face 61, as seen in FIG. 4, in notch 79 the set-back face 81 is on the left of the operative face 80. With this arrangement, during the rolling up of the shutter, when the first lock bolt 51 projects and transmits the torque from the winch to the winding shaft 15, the other lock bolt 74 is retracted and the second shaft 17 can rotate freely in relation to sprocket 65. This is because the lock bolt 74 does not engage a radial surface like operative face 80, and allows the second shaft 17 to rotate freely.

When unrolling the shutter 2, the winch drives the sprocket 43, chain 64 and sprocket 65. The lock bolt 74 projects into its notch 77 and the hub 66 rotatably drives the other shaft 17 as a consequence of the thrust exerted by said lock bolt 74 against the operative face 80 of notch 79, so as to rotate the freewheel end member 71 and consequently the cam wheel 19 and the second shaft 17.

This second shaft 17 carries at its other end 82 another cam wheel 83 rotatably coupled with this shaft 17 via a fastening member 84 interconnecting the wheel 83 and an end member 85 having its hub 86 engaged in a plummer block 87 of a ball-bearing 88, this plummer-block 87 being rigid with the inner face 38 of the lateral flange or wall 39 of the shutter housing.

Figure 5:
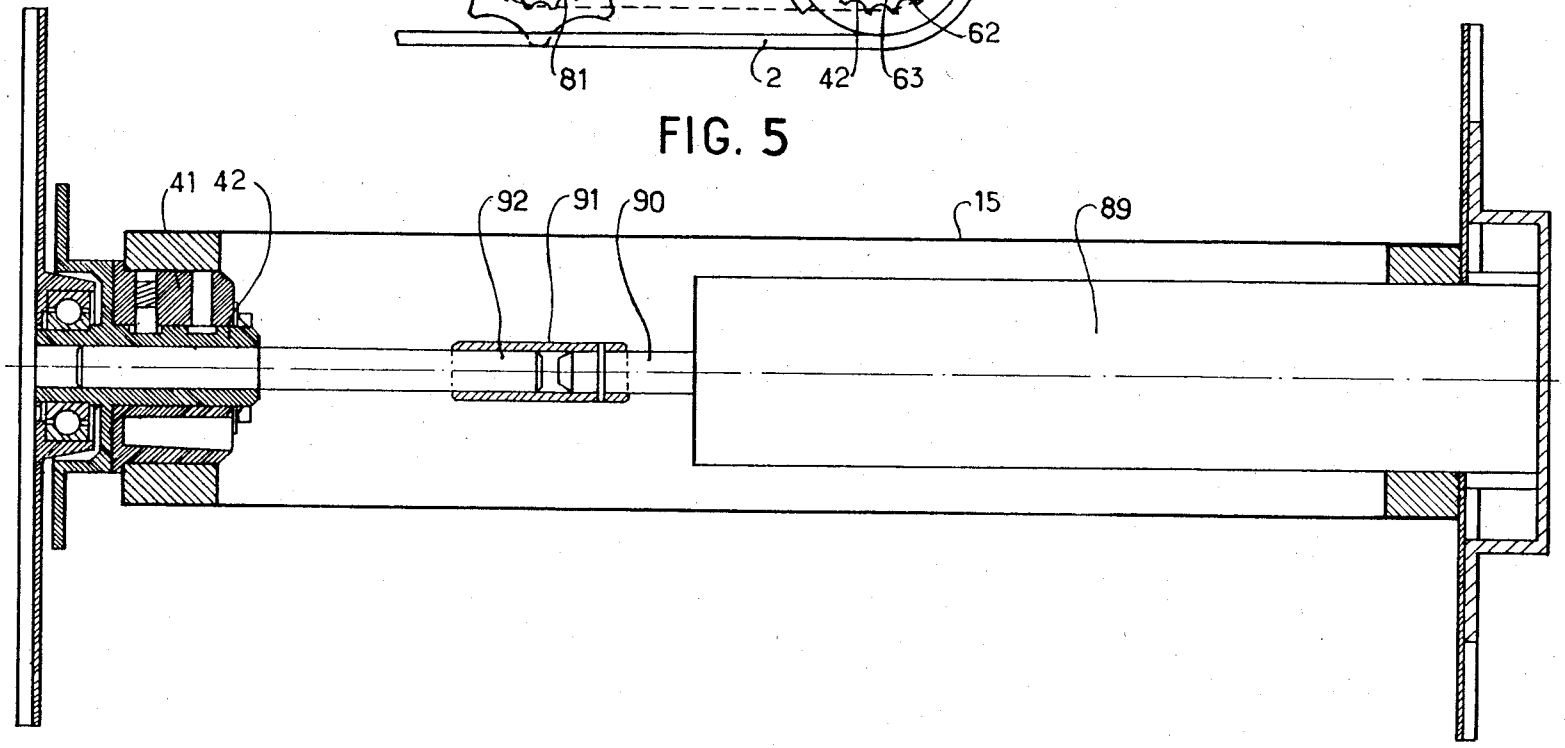
FIG. 5 is a sectional and plane view showing the means for driving the winding and/or unwinding shaft of the sectional shutter.

FIG. 5 illustrates another form of embodiment of the present invention wherein a driving motor 89 is incorporated in winding shaft 15. The output shaft 90 of motor 89 is coupled by means of a sleeve 91 with a driven shaft 92 rotatably connected to the hub 42 and the freewheel end member 41. All the other component elements of this assembly are identical with those described with reference to the preceding form of embodiment.

Though specific forms of embodiment of the present invention are described and illustrated herein, it will readily occur to those conversant with the art that various modifications and changes may be brought thereto without departing from the basic principles of the invention.

What is claimed is:

1. A rolling shutter, which comprises:

a sectional shutter structure, the shutter structure having a plurality of blades arranged in a side-by-side relationship, adjacent blades being hingedly interconnected, each blade including a stud projecting outwardly from at least one lateral edge thereof;

a rotatable first shaft coupled to the shutter, the shutter being adapted to be rolled about and unrolled from the first shaft;

a rotatable second shaft disposed parallel to the first shaft;

at least one cam wheel mounted on one end of the second shaft and rotatable therewith, the cam wheel being positioned relative to the shutter structure to engage the stud of each shutter blade, the cam wheel having a spider-like configuration and including radially extending arms, the arms having sides which have the shape of an involute of a curve to allow the stud of each shutter blade to slip along the sides of the cam wheel arms, wherein the cam wheel provides a backlash so that the wheel can positively engage the studs of the shutter blades;

drive means for driving at least one of the first shaft and the second shaft; and disconnecting means for selectively and alternately disconnecting the drive means from the first and second shaft as a function of the direction of travel of the shutter structure, wherein the disconnecting means includes transmission means, the transmission means including a first freewheel end member mounted on the first shaft, and a second freewheel end member mounted on the second shaft, each freewheel end member including a lock bolt mounted thereon and positionable in a locking position and an unlocking position, and means for resiliently urging the lock bolt into a locking position, wherein each freewheel end member includes an inner bore, and a sprocket received by the inner bore, the lock bolt of each member being adapted to extend into the inner bore and engage a notch formed in the sprocket, and wherein each sprocket includes an operative face defining a portion of the notch formed therein, and a set-back face extending at a right angle to the operative face, wherein the lock bolt of each freewheel end member engages the operative face of the sprocket to cause the respective shaft to rotate in one direction, and engages the set-back face of the sprocket and is retracted thereby to allow the respective shaft to rotate freely in the opposite direction.

2. A rolling shutter as defined by claim 1, wherein the operative and set-back faces of the notch of the first freewheel end member are oppositely disposed to the operative and set-back faces of the second freewheel end member to allow the first shaft to be driven rotatably when the second shaft is freely rotatable, and to allow the first shaft to be freely rotatable when the second shaft is driven rotatably.

* * * * *